US009175625B2

(12) United States Patent
Kumar et al.

(10) Patent No.: US 9,175,625 B2
(45) Date of Patent: Nov. 3, 2015

(54) APPROACH FOR ENGINE CONTROL AND DIAGNOSTICS

(71) Applicant: Ford Global Technologies, LLC, Dearborn, MI (US)

(72) Inventors: Pankaj Kumar, Dearborn, MI (US); Imad Hassan Makki, Dearborn Heights, MI (US); Dimitar Petrov Filev, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/180,541

(22) Filed: Feb. 14, 2014

(65) Prior Publication Data

US 2015/0233315 A1 Aug. 20, 2015

(51) Int. Cl.
*F01N 3/00* (2006.01)
*F02D 41/02* (2006.01)

(52) U.S. Cl.
CPC ..... *F02D 41/0295* (2013.01)

(58) Field of Classification Search
CPC ..... F01N 11/007; F01N 2550/02; F01N 2560/025; F01N 2560/14; F01N 2900/1402; F01N 2900/1621; F01N 2900/1624; F02D 41/0235; F02D 41/0295; F02D 41/1441; F02D 41/1454; F02D 41/1458; F02D 41/182; F02D 2200/0814; F02D 41/1456; Y02T 10/22; Y02T 10/47
USPC ..... 60/274, 277, 285
See application file for complete search history.

(56) References Cited

U.S. PATENT DOCUMENTS

| | | | | |
|---|---|---|---|---|
| 4,462,208 | A * | 7/1984 | Hicks et al. | 60/286 |
| 5,998,210 | A * | 12/1999 | Hepburn et al. | 436/37 |
| 2003/0093991 | A1 * | 5/2003 | Makki et al. | 60/285 |
| 2007/0256406 | A1 * | 11/2007 | Makki et al. | 60/277 |
| 2012/0180456 | A1 * | 7/2012 | Yamada et al. | 60/274 |
| 2013/0245919 | A1 | 9/2013 | Kumar et al. | |

OTHER PUBLICATIONS

Kumar, P. et al., "A low-dimensional model for describing the oxygen storage capacity and transient behavior of a three-way catalytic converter," Chemical Engineering Science Journal, vol. 73, pp. 373-387, 2012, 15 pages.

* cited by examiner

*Primary Examiner* — Jason Shanske
*Assistant Examiner* — Matthew T Largi
(74) *Attorney, Agent, or Firm* — Julia Voutyras; Alleman Hall McCoy Russell & Tuttle LLP

(57) ABSTRACT

Embodiments for an engine exhaust are provided. In one example, a method comprises adjusting a fuel injection amount based on a fractional oxidation state of a catalyst, the fractional oxidation state based on reaction rates of a plurality of exhaust gas species throughout a catalyst longitudinal axis and a set of axially-averaged mass balance and energy balance equations for a fluid phase and a washcoat of the catalyst, and further based on feedback from a downstream air-fuel ratio sensor. In this way, a simplified catalyst model may be used to control air-fuel ratio.

19 Claims, 6 Drawing Sheets

APPROACH FOR ENGINE CONTROL AND DIAGNOSTICS

FIELD

The present disclosure relates to feedback control of air-fuel ratio in an internal combustion engine.

BACKGROUND AND SUMMARY

Efficient conversion of exhaust gas emissions in a gasoline engine includes maintaining the catalyst feedgas air-fuel ratio at a narrow window around stoichiometry. However, during actual engine operation, slight excursions away from stoichiometry may occur. To increase the operating window and thus improve emissions performance, catalysts often include ceria to provide a buffer for oxygen storage. To maintain optimal catalyst performance, stored oxygen may be maintained at a desired set point, calibrated based on engine load and temperature, via feedback control of engine air-fuel ratio.

However, the inventors herein have recognized an issue with the above approach. Determining the level of stored oxygen in a catalyst typically involves utilization of a physics-based catalyst model that includes a plurality of partial differential equations in one or more dimensions. Such a model may be difficult to implement and may require more processing power than typically available in an engine controller.

Thus in one example, the above issue may be at least partly addressed by a method for an engine exhaust system. In one embodiment, the method comprises adjusting a fuel injection amount based on a fractional oxidation state of a catalyst, the fractional oxidation state based on reaction rates of a plurality of exhaust gas species throughout a catalyst longitudinal axis and a set of axially-averaged mass balance and energy balance equations for a fluid phase and a washcoat of the catalyst, and based on feedback from a downstream air-fuel ratio sensor.

In another example, an engine exhaust method, comprises adjusting a fuel injection amount based on: a fractional oxidation state (FOS) of a catalyst relative to an FOS set-point, the FOS based on reaction rates of a plurality of exhaust gas species throughout a catalyst longitudinal axis and a set of axially-averaged mass balance and energy balance equations, and separate feedback from a downstream HEGO sensor relative to a HEGO set-point, the FOS and HEGO set-points tied together.

The present disclosure may offer several advantages. For example, processing resources devoted to the catalyst model may be reduced. Further, emissions control may be improved by maintaining the catalyst at a desired fractional oxidation state. In addition, the evolution of exhaust species, such as HC, NOx and CO, or aggregate oxidants and reductants, may be monitored, and if breakthrough is predicted, an operator of the vehicle may be notified and/or additional engine control operations may be undertaken to control the production of the exhaust species. Another advantage of the present approach is that it offers a non-intrusive catalyst monitor for control and diagnostics, which is less dependent on sensor location and hence will be equally applicable to both partial and full volume catalyst systems. Finally, by tying together the two set-points in this way, controller robustness can be improved while limiting complexity and calibration efforts.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

To reduce the breakthrough of emissions, catalysts may utilize oxygen storage material, for example ceria in the form of cerium oxide, to provide buffer for oxygen during rich or lean excursions. The air-fuel ratio entering the catalyst may be controlled such that the oxidation state of the catalyst is maintained at a desired level. In one example model of the present disclosure, the concentration of various exhaust gas species, such as $H_2$, CO, NOx, HC, and $O_2$, at the inlet through the outlet of the catalyst may be modeled using a simplified low-dimensional model. The model accounts for complex catalyst dynamics, such as diffusion and reaction in the washcoat and catalyst aging, and simplifies the dynamics into a set of axially-averaged model equations. The model equations track the balance of each exhaust species in the fluid phase and in the washcoat of the catalyst. Further, the model compensates for overall energy balance in the fluid phase and the washcoat of the catalyst.

Figure 1:
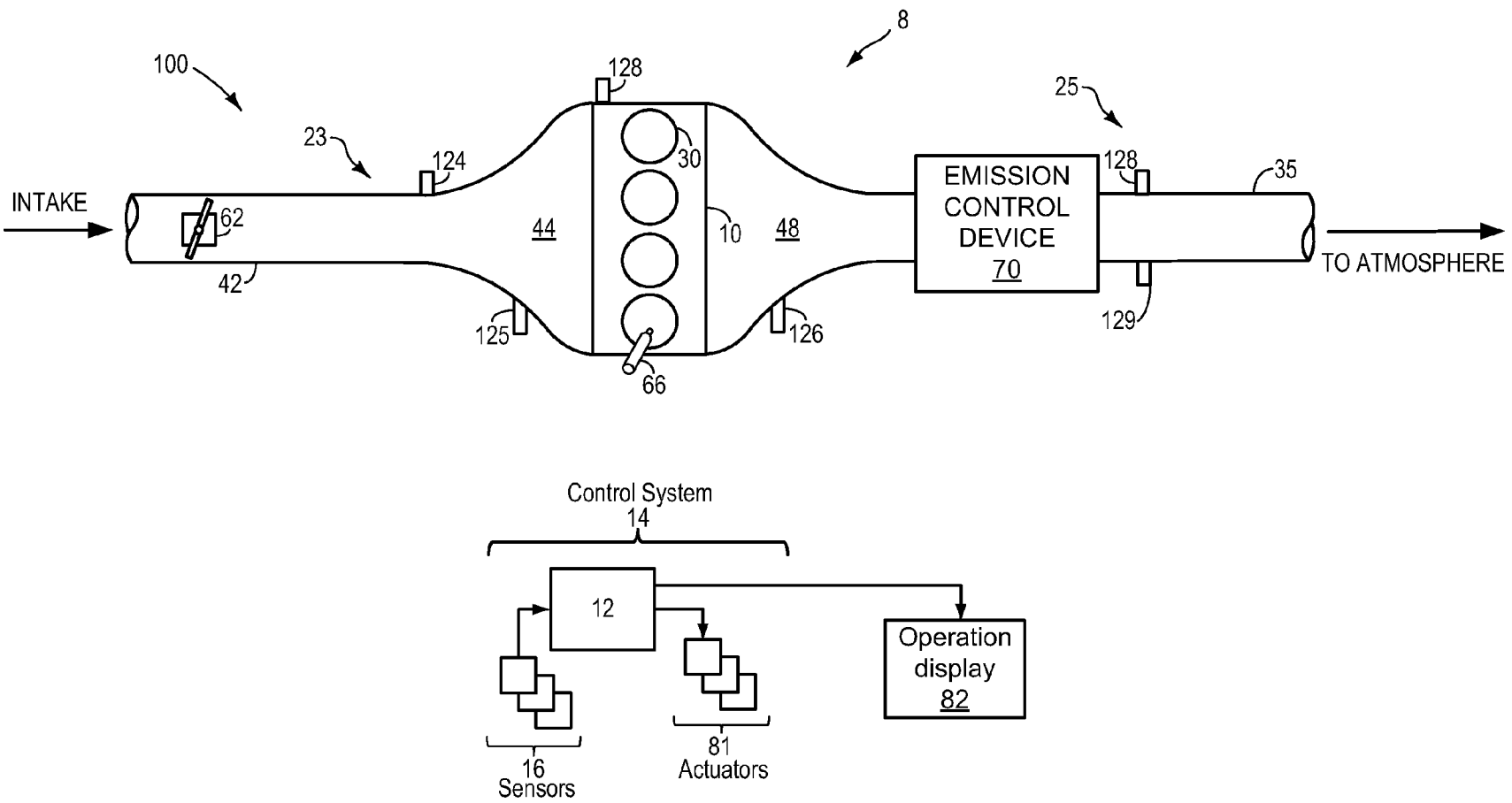
FIG. 1 schematically shows an example vehicle system.

In particular, the model may track the change in the concentration of oxidants and reductants in order to determine a fractional oxidation state of the catalyst, which may be used to control the air-fuel ratio of the engine. Further, a catalyst gain may be determined and applied to the model to track a change in total oxygen storage capacity, which may indicate whether or not the catalyst is degraded. Additionally, the concentration of the various exhaust components may be used to predict overall tailpipe emissions. FIG. 1 shows an example engine including a catalyst and a control system. FIGS. 2-5 illustrate various control routines that may be carried out by the engine of FIG. 1.

FIG. 1 shows a schematic depiction of a vehicle system 6. The vehicle system 6 includes an engine 10 having a plurality of cylinders 30. The engine 10 includes an intake 23 and an exhaust 25. The intake 23 includes a throttle 62 fluidly coupled to the engine intake manifold 44 via an intake passage 42. The exhaust 25 includes an exhaust manifold 48 leading to an exhaust passage 35 that routes exhaust gas to the atmosphere. The exhaust 25 may include one or more emission control devices 70, which may be mounted in a closecoupled position in the exhaust. One or more emission control devices may include a three-way catalyst, lean NOx trap, diesel or gasoline particulate filter, oxidation catalyst, etc. It can be appreciated that other components may be included in the engine such as a variety of valves and sensors.

Engine 10 may receive fuel from a fuel system (not shown) including a fuel tank and one or more pumps for pressurizing fuel delivered to the injectors 66 of engine 10. While only a single injector 66 is shown, additional injectors are provided for each cylinder. It can be appreciated that the fuel system may be a returnless fuel system, a return fuel system, or various other types of fuel system. The fuel tank may hold a plurality of fuel blends, including fuel with a range of alcohol concentrations, such as various gasoline-ethanol blends, including E10, E85, gasoline, etc., and combinations thereof.

The vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 (such as a linear UEGO sensor) located upstream of the emission control device, temperature sensor 128, and downstream exhaust gas sensor 129 (such as a binary HEGO sensor). Other sensors such as pressure, temperature, and composition sensors may be coupled to various locations in the vehicle system 6, as discussed in more detail herein. In one example, an actuator may include a "message center" including an operation display 82 where, in response to an indication of catalyst degradation, a message may be output to a vehicle operator indicating a need to service the emission system, for example. As another example, the actuators may include fuel injector 66, and throttle 62. The control system 14 may include a controller 12. The controller may receive input data from the various sensors, process the input data, and trigger the actuators in response to the processed input data based on instructions or code programmed therein corresponding to one or more routines. Example control routines are described herein with regard to FIGS. 2-5.

For catalyst diagnostics, various input parameters into a catalyst model may be used. In one embodiment, the input parameters may include catalyst gain, air amount (AM) such as mass airflow rate from MAF sensor, catalyst temperature estimated based on engine operating conditions such as speed, load, etc., HEGO output, and UEGO output. In some embodiments, all the example inputs listed above may be used in the catalyst model. In another embodiment, a HEGO model may be used in series with the catalyst model. In such a model, the model estimated voltage is compared with the measured sensor voltage (e.g., HEGO voltage), and the error computed is then used to update the catalyst activity ($a_c$). The catalyst activity is used as an indicative of catalyst age for diagnostics. This model-based approach is non-intrusive and less dependent on the HEGO sensor location, making it equally valid for both partial and full volume catalyst. In other embodiments, only a subset of the input parameters may be used, such as catalyst temperature and catalyst gain.

Figure 2:
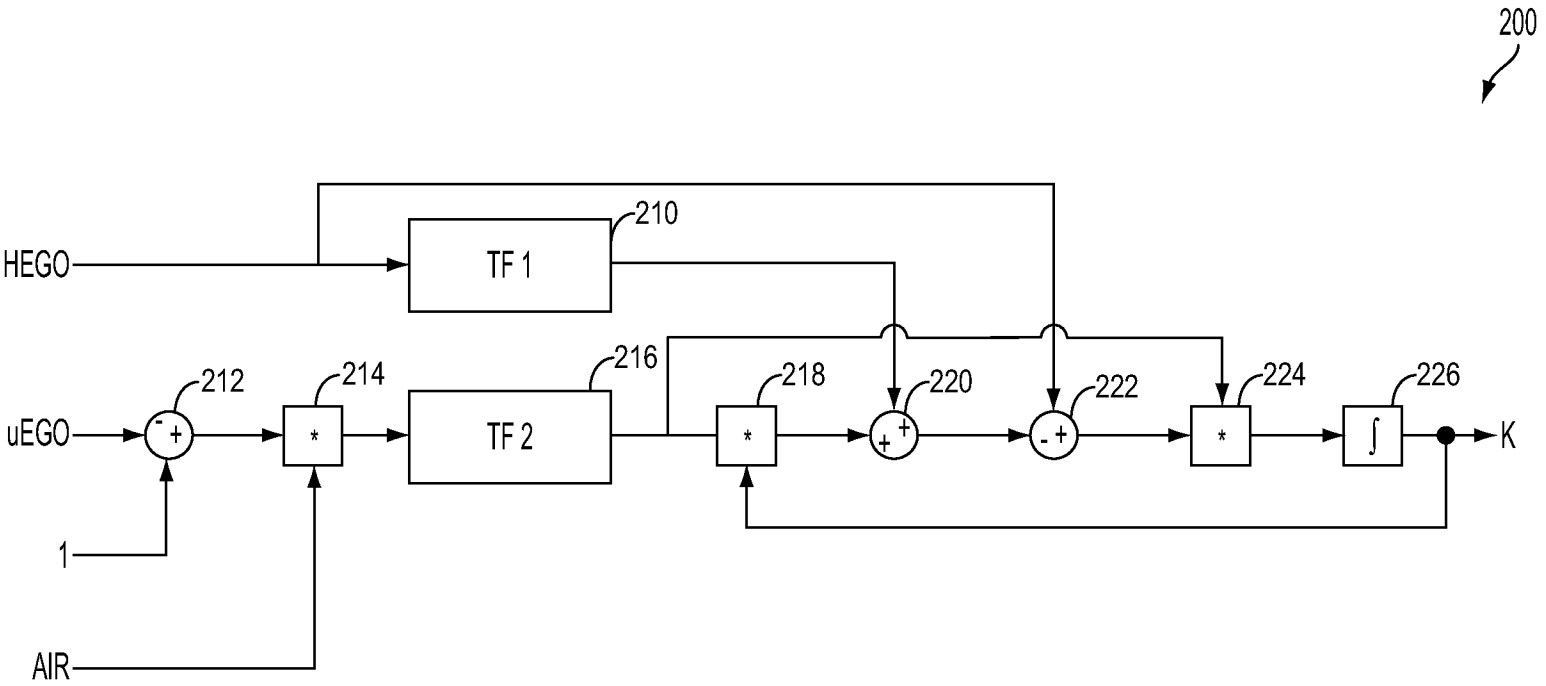
FIG. 2 illustrates a control operation for estimating catalyst gain.

The catalyst gain is an on-line estimation of the oxygen storage capacity of the catalyst, which reduces as the catalyst ages, and is illustrated in FIG. 2. The example function of FIG. 2 shows that the catalyst gain is a function of airmass, catalyst temperature, and relative exhaust air-fuel ratio (e.g., lambda). The catalyst gain can be indicative of catalyst conditions, such as an amount of oxygen stored in the catalyst, catalyst conversion efficiency, etc.

FIG. 2 illustrates an example function 200 of calculating catalyst gain from UEGO and HEGO sensor inputs. The catalyst gain may be defined as a linear, time-independent system that responds as an impulse to the inputs described above. Determining the catalyst gain relies on transfer functions (TF), which represent the relationship between the inputs and the outputs in the system. The two transfer functions (TF) are shown below in the laplace domain with s being the Laplace operator:

$$\frac{a}{s+a} \qquad \text{Transfer function 1 (TF1)}$$

$$\frac{b(s)}{conv([x\ y],\ [x\ z])(s)} \qquad \text{Transfer function 2 (TF2)}$$

Where w=conv(u,v) convolves vectors u and v. Algebraically, convolution is the same operation as multiplying the polynomials whose coefficients are the elements of u and v.

Determining the catalyst gain comprises determining the output of TF1 using input from the HEGO sensor at 210. This output may be fed into the output of TF2, as will be described in more detail below. At 212, the difference between the UEGO sensor output and lambda (e.g. 1) is determined, and this difference is multiplied by the air mass at 214. This product is used as the input for TF2 at 216. As the catalyst gain may be calculated and updated continually, the output of previous catalyst gain determinations may be fed into the function at 218. The product of TF2 and previous catalyst gain may be added to the output of TF1 at 220. At 222, the difference is determined between the input from the HEGO sensor and the product of 220, and this is multiplied by the output of TF2 at 224. To determine the catalyst gain, K, the integral is taken at 226 of the product determined in 224.

Figure 3:
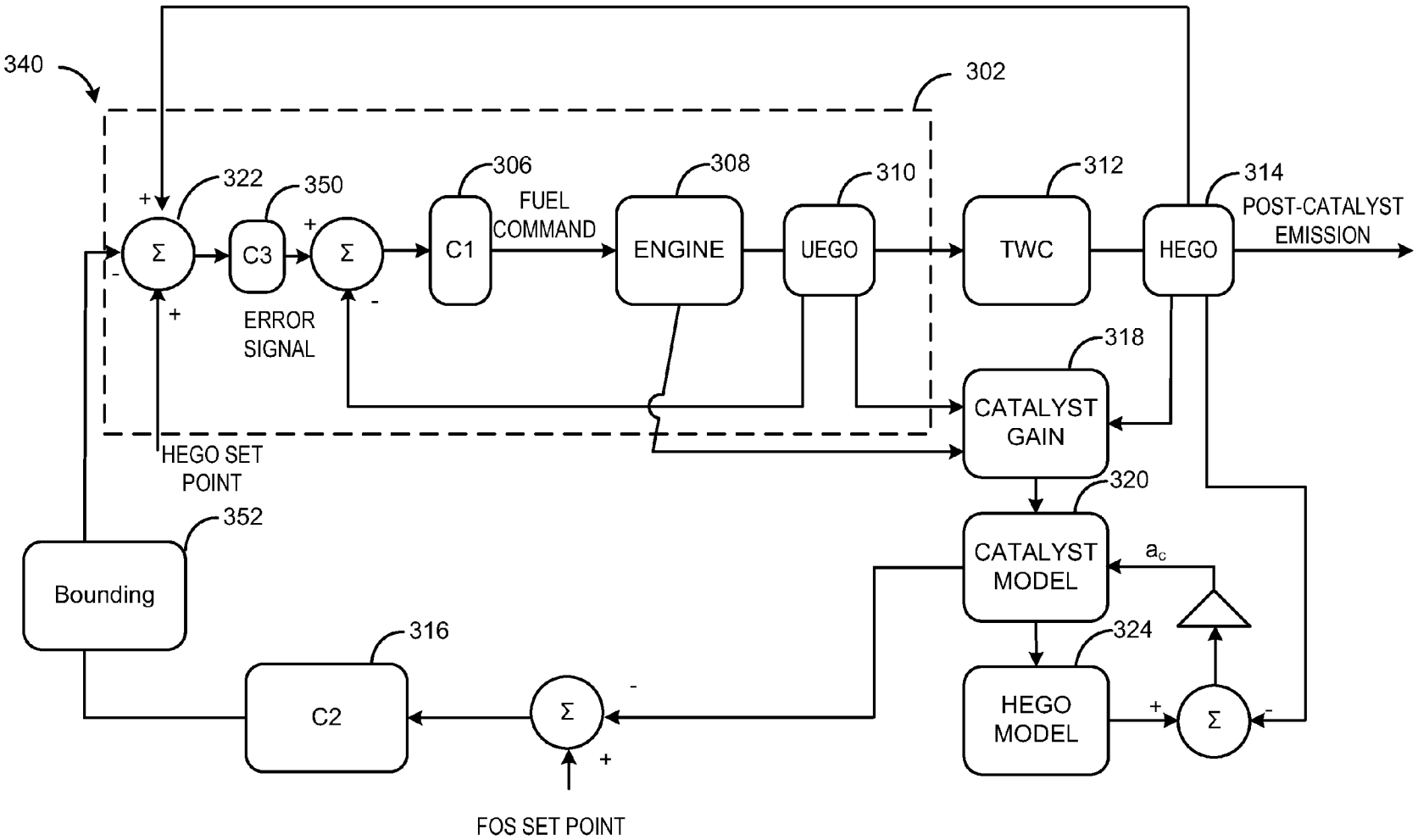
FIG. 3 schematically shows an example diagram of inner and outer loop control strategies in coordination with model feedback.

FIG. 3 includes an example diagram depicting inner loop and outer loop control strategies for maintaining air-fuel ratio in an engine. Engine 10 and emission control device 70 of FIG. 1 are non-limiting examples of engine components which may be monitored and/or controlled using the following control strategies. FIG. 3 depicts an example diagram 300 including an inner loop 302 and an outer loop (one based on sensor feedback without model estimates, and the other based on model estimates). The inner loop 302 control strategy includes a first air-fuel controller C1 306, which supplies a fuel command to the engine 308. The engine produces exhaust, the oxygen concentration of which is determined by an upstream sensor, such as a UEGO 310, before reaching a catalyst, such as TWC 312. The outer loop includes information from a downstream oxygen sensor, such as HEGO 314, which is fed to a second air-fuel controller C2 316 only after it has been used as an input to the various model estimates described herein. Output from a catalyst gain model 318 (see FIG. 2), which receives input from UEGO 310, engine 308, and HEGO 314, is fed into a catalyst model 320 (see FIG. 5), and which is compared with a fractional oxidant state (FOS) setpoint for the catalyst. As will be explained in more detail below, the catalyst model determines a total oxygen storage capacity and fractional oxidation state (FOS) of the catalyst. A difference may be determined between the output of C2 and the UEGO signal at 322, which is output as an error signal to the first controller C1.

Additionally, the catalyst model 320 receives input from a HEGO model 324 in addition to the catalyst gain model. HEGO model 324 may be used in series with the catalyst model 320. The HEGO model 324 compares HEGO voltage as predicted by the catalyst model 320 to measured HEGO voltage. The error computed is then used to update the catalyst activity ($a_c$).

Further, an additional outer loop controller C3 (350) is provided to combine the advantages of both the model-based control architecture described above while achieving a robust outer loop control. Specifically, the outer loop controller C3 is positioned in series to take advantage of the fractional oxidation state predicted from the physics based models to modulate the downstream air-fuel ratio sensor for improved performance. The advantage of the methodology comes from the fact that with the FOS, the internal state of the catalyst would be known providing early feedback to correct for any deviation from desired A/F, while still being robust against potential instability in the estimate of the FOS. As described in further detail below, the correction provided by the FOS controller will be bounded at 352, to reduce the potential that the error from the FOS estimation increases controller instability. The bounding may include limiting the upper and lower bounds of the fractional oxidant state estimated in the catalyst. In one example, the bounding of the output by the controller 316 may be bounded based on feedback from the outer loop controller C3. Controller C3 may be a PI controller and may be tuned with various linear and/or non-linear control gains. Further, in one example, controller C3 is not model-based, so as to avoid model estimation errors.

As shown in FIG. 3, the additional feedback from the outer loop controller C3 is in addition to, and separate from the feedback from the catalyst model through controller C2. That is why the approach is so advantageous in terms of its ability to reduce instability of the FOS estimate.

Figure 6:
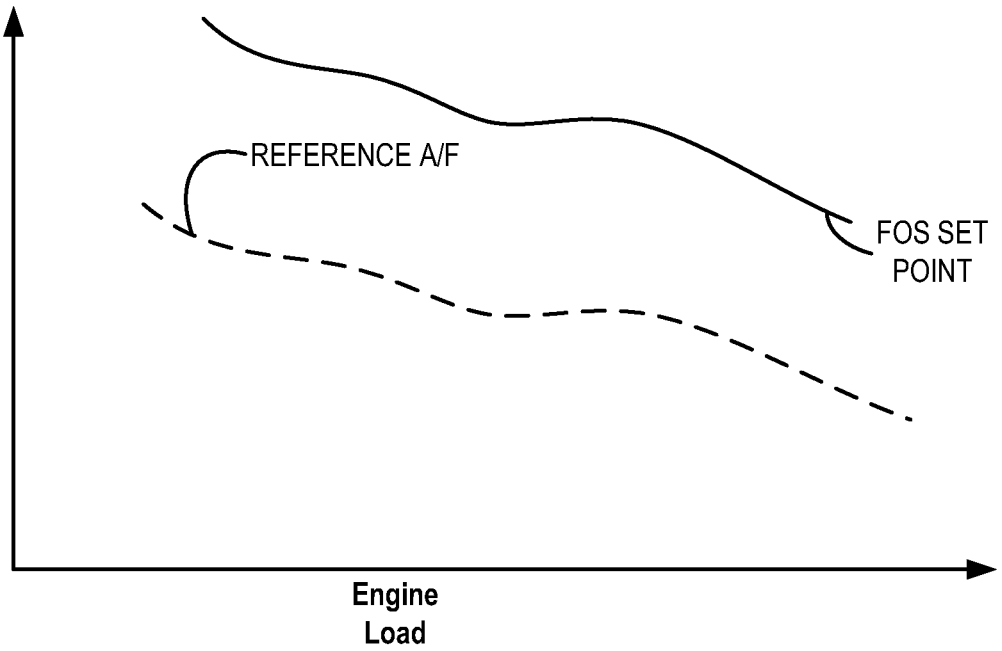
FIG. 6 shows graphs of set-points as a function of various parameters, the set-points applied to the controller of FIG. 3.
Figure 6:
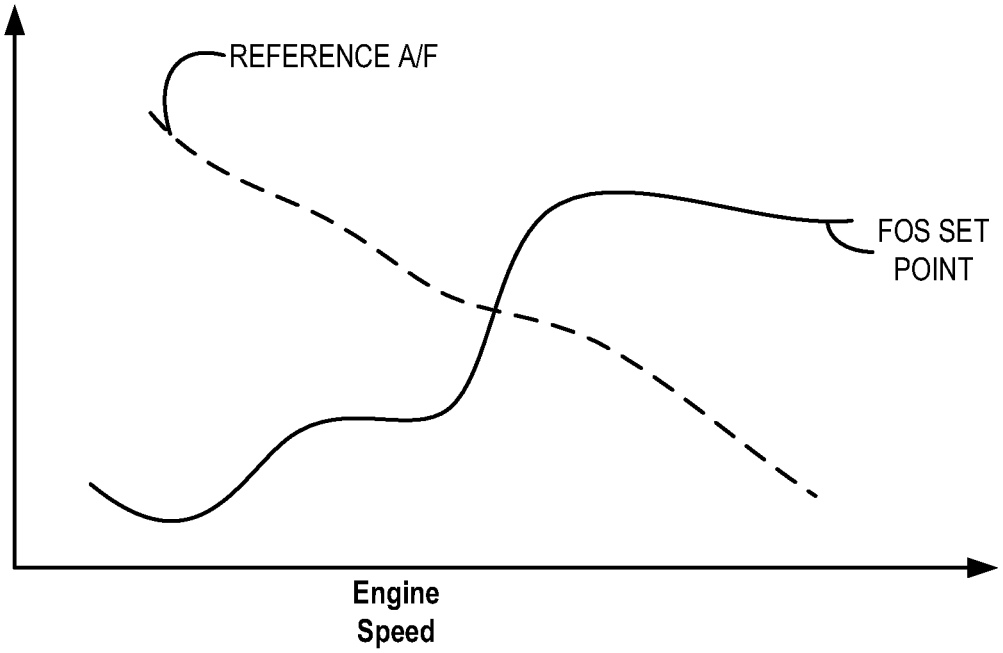

The FOS and downstream air-fuel ratio set points can also be related to each other through a steady-state map of set-points for the downstream air-fuel ratio sensor (HEGO) vs. FOS to reduce contradictory set points. For example, a steady-state map may generate the HEGO set point and FOS set-point from current engine speed and load, for example. In this way, because the HEGO set point and FOS set-point are tied directly to one another, system variance cannot cause them to drift to incompatible values. Specifically, paired sets of HEGO set-point and FOS set-point values specific a set of current operating conditions may be provided. As an example, FIG. 6 shows any example graph illustrating how the set-points can be coordinated together as a function of engine speed. Note that while the set-points are coordinated, they do not necessary change in the same way with changes in engine speed, although they may for some ranges of engine speed. Note that FIG. 6 shows the relative increasing/decreasing of the set-points as a function of engine speed (lower graph) or engine load (upper graph). In still another example, the set-points may be a function of both engine speed and load, and in such case the average value read for the current speed/load combination of the current conditions may be used to determine the respective setpoints applied in the control system of FIG. 3.

Figure 4:
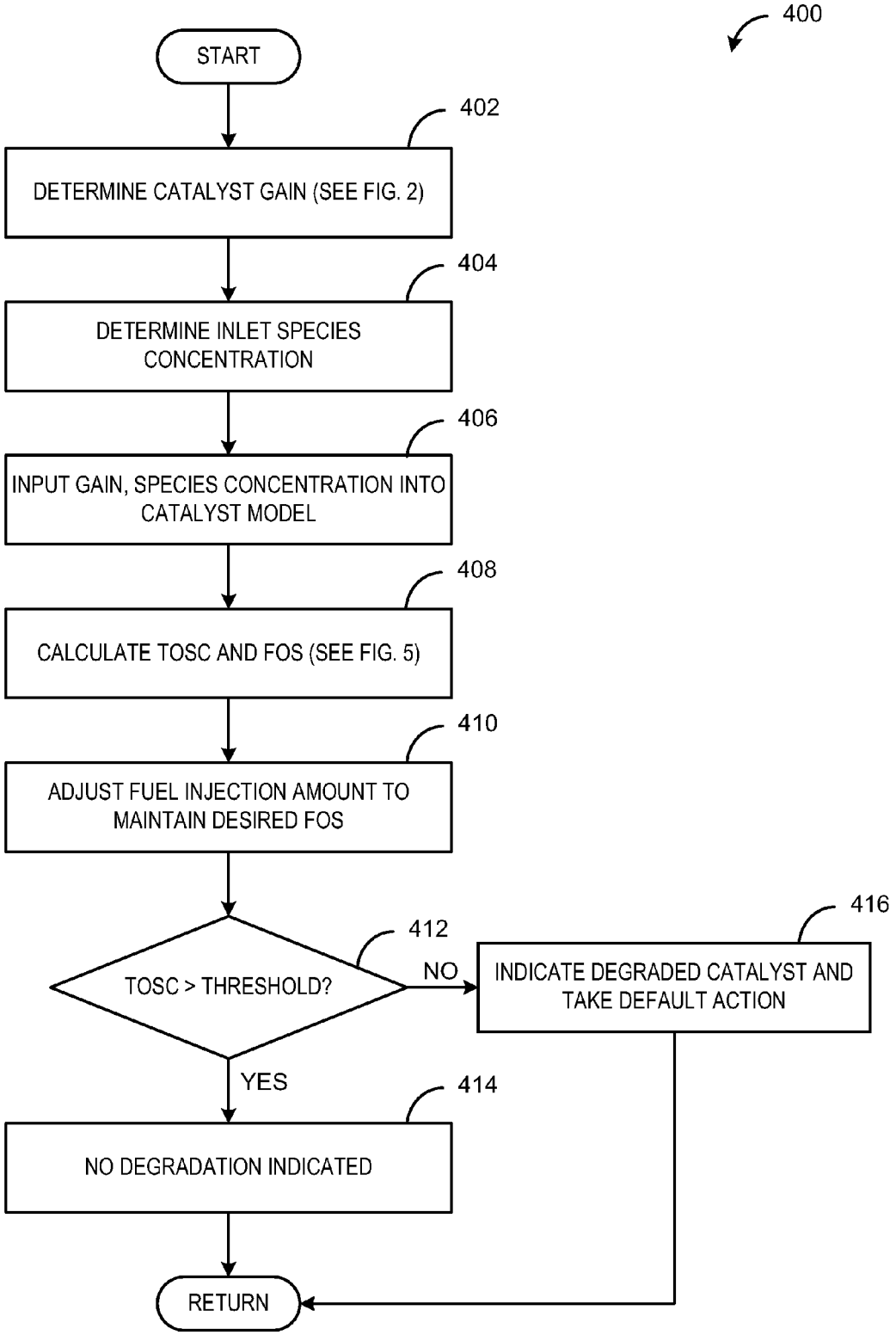
FIG. 4 is a flow chart illustrating an example method for monitoring a catalyst according to an embodiment of the present disclosure.

Coordinating the setpoints of the FOS and the outer loop air-fuel ratio for the downstream air-fuel ratio sensor also FIG. 4 is a flow chart illustrating a method 400 for monitoring a catalyst according to an embodiment of the present disclosure. Method 400 may be carried out by an engine control system, such as control system 14 of FIG. 1, using feedback from various engine sensors. At 402, method 400 includes determining catalyst gain. Catalyst gain may be determined according to the process described above with respect to FIG. 2. At 404, the concentration of exhaust species at the inlet of the catalyst is determined. Determining the concentration of the inlet species may include determining the concentration of one or more of $O_2$, $H_2O$, CO, HC, NOx, $H_2$, and $CO_2$. The inlet species concentrations may be determined based on one or more of air mass, temperature, air-fuel ratio, engine speed, spark timing, and load. For example, the respective species concentrations may be mapped to air mass, temperature, air-fuel ratio, and engine speed offline, and the concentrations stored in a look-up table in the memory of the control system.

At 406, the catalyst gain and species concentration are input into a catalyst model. In another embodiment, a HEGO model is used to update the catalyst activity in real time instead of catalyst gain. The catalyst model includes a set of axially-averaged ordinary differential equations that calculate, for the longitudinal axis of a catalyst channel, a balance in the fluid phase of the catalyst for each species, a balance in the washcoat of the catalyst for each species, the energy balance of the fluid phase and washcoat, and the oxidation/reduction balance of ceria in the catalyst. At 408, the total oxygen storage capacity and fractional oxidation state of the catalyst are determined from the catalyst model, which will be explained in greater detail with respect to FIG. 5 below. At 410, fuel injection is adjusted to maintain a desired fractional oxidation state. For example, it may be desired to maintain the fractional oxidation state of the catalyst (e.g., the fractional oxidation of ceria within the catalyst) at a desired level, calibrated based on engine load and temperature, for optimal performance, such as 50%.

At 412, it is determined if the total oxygen storage capacity of the catalyst is greater than a threshold. The total oxygen storage capacity of the catalyst is indicative of the state of the catalyst, e.g., a fresh catalyst will have a relatively high oxygen storage capacity while a degraded catalyst will have a relatively low oxygen storage capacity, due to the diminished capacity of the ceria to store oxygen. The total oxygen storage capacity of a fresh catalyst may be determined based on the amount of ceria present in the catalyst during production, or it may be determined during initial operation of the catalyst. The threshold may be a suitable threshold below which the catalyst ceases to effectively control emissions. If the total oxygen storage capacity is greater than the threshold, no degradation is indicated at 414, and then method 400 returns. If the total oxygen storage capacity is not greater than the threshold, that is if the oxygen storage capacity is less than the threshold, catalyst degradation is indicated 416, and default action is taken. Default action may include notifying an operator of the vehicle via a malfunction indicator lamp, setting a diagnostic code, and/or adjusting engine operating parameters in order to reduce emissions production. Method 400 then returns.

Figure 5:
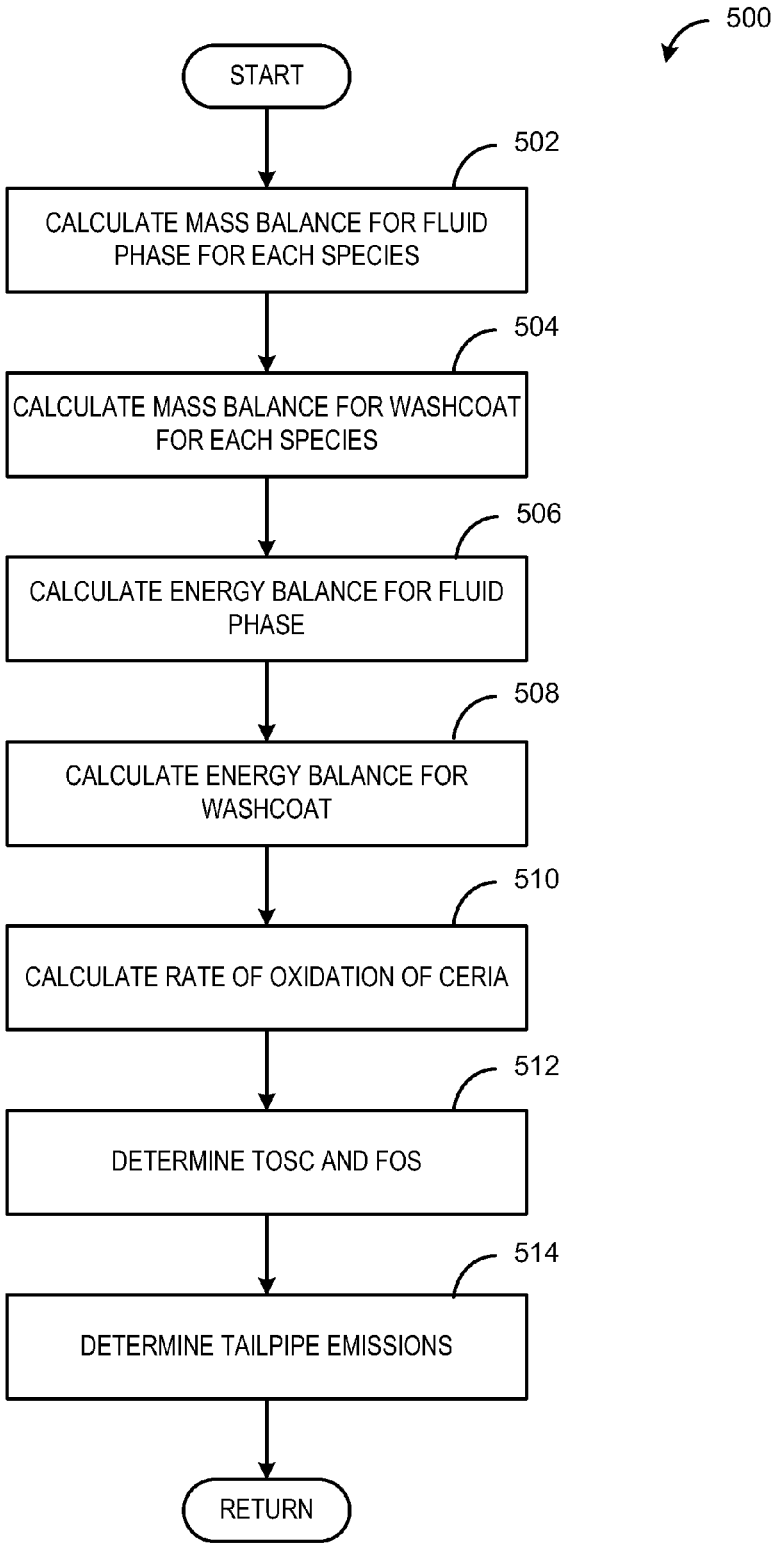
FIG. 5 is a flow chart illustrating an example method for determining an oxidation state of a catalyst according to an embodiment of the present disclosure.

FIG. 5 is a flow chart illustrating a method 500 for determining an oxidation state of a catalyst using a catalyst model. Method 500 may be carried out by engine control system 14 during execution of method 400 of FIG. 4. At 502, the mass balance for the fluid phase of the catalyst for each species is calculated. The mass balance accounts for the transfer of species mass from the fluid phase to the washcoat. The mass balance for the fluid phase may be calculated using the following equation (1):

$$\frac{dX_{fm}}{dt} = -\frac{\langle u \rangle}{L}(X_{fm} - X_{fm}^{in}(t)) - \frac{K_{mo}}{R_{\Omega}}(X_{fm} - \langle X_{wc} \rangle)$$

Where $X_{fm}$ is the mole fraction of gaseous species in the bulk fluid phase, $\langle x_{wc} \rangle$ is the mole fraction of the species in the washcoat, $R_{\Omega}$ is the hydraulic radius of the channel, $\langle u \rangle$ is the average feedgas velocity, L is the length of the catalyst, and $K_{mo}$ is the mass transfer coefficient between the fluid and the washcoat, defined as:

$$K_{mo}^{-1}=K_{me}^{-1}+K_{mi}^{-1}$$

Here, $k_{me}$ and $k_{mi}$ are the external and internal mass transfer coefficients.

At 504, the mass balance for the washcoat for each species, which accounts for the contribution from the mass transfer from the interface to the bulk washcoat and consumption due to the reaction, is calculated using the following equation (2):

$$\varepsilon_w \frac{d\langle X_{wc}\rangle}{dt} = \frac{1}{C_{Total}} v^T r + \frac{K_{mo}}{\delta_c}(X_{fm} - \langle X_{wc}\rangle)$$

Where r is the reaction rate, $\epsilon_w$ is the porosity of the washcoat, $\upsilon$ represents the stoichiometric matrix, and $\delta_c$ is the washcoat thickness.

At 506, the energy balance for the fluid phase is calculated, using the following equation (3):

$$\rho_f Cp_f \frac{dT_f}{dt} = -\frac{\langle u\rangle \rho_f Cp_f}{L}(T_f - T_f^{in}(t)) - \frac{h}{R_\Omega}(T_f - T_s)$$

Where $\rho_f$ is the average density of gas, $T_f$ is the temperature of fluid phase, $T_f^{in}$ represents the feed inlet temperature, $T_s$ is the temperature of the solid phase, $Cp_f$ is the specific heat capacity, and h is the heat transfer coefficient.

At 508, the energy balance for the washcoat is calculated, using the equation (4):

$$\delta_w \rho_w Cp_w \frac{dT_s}{dt} = h(T_f - T_s) + \delta_c \sum_i^{Nr} r_i(-\Delta H_i)$$

Where $\delta_c$ is the washcoat thickness and $\delta_w$ is the effective wall thickness.

At 510, the rate of oxidation of ceria is calculated using the following equation (5):

$$\frac{d\theta}{dt} = \frac{1}{2TOSC}(R_{storage} + R_{release})$$

Where θ is the fractional oxidation state of ceria (FOS), $$\theta = \frac{[Ce_2O_4]}{2[Ce_2O_4] + [Ce_2O_3]}$$

The rate of storage ($r_2$), $R_{storage}$ and the rate of release ($r_3$), $R_{release}$ of oxygen from ceria may be based on the following equations:

$$r_2 = a_c A_2 \exp\left(\frac{-E_2}{RT}\right) X_{O2}(1-\theta) TOSC_{green}$$

$$r_3 = a_c A_3 \exp\left(\frac{-E_3}{RT}\right) X_A(\theta) TOSC_{green}$$

Where $a_c$ is the catalyst activity, or the aging parameter of the catalyst. The aging parameter of the catalyst is indicative of the oxygen storage state of the catalyst. For example, as the catalyst ages, its capacity to store oxygen may diminish. In one example, an aging parameter of one indicates a fresh catalyst, with decreasing aging parameters indicating decreased capacity to store oxygen. The aging parameter may be based on bulk estimates of upstream air/fuel ratio, downstream air/fuel ratio, air mass, and temperature. In some embodiments, the aging parameter may be computed from the predetermined catalyst gain, described with respect to FIG. 2. In another embodiment, a HEGO model is used in series with the catalyst model to estimate the downstream HEGO voltage and then, using the measured HEGO voltage, an error is computed which is used to update catalyst activity. The terms A and E indicate the pre-exponential factor and activation energy, respectively. A and E are tunable parameters which may be optimized offline, using a genetic algorithm or other non-linear constrained optimization.

At 512, the fractional oxidation state (FOS) and the total oxygen storage capacity (TOSC) are determined. The FOS may be determined using the equation for θ above, and further based on the equation (6):

$$\lambda = \frac{1}{\left(2 + \frac{y}{2}\right)} \frac{([CO] + [NO] + 2[CO_2][H_2O] + 2[O_2])}{([CO] + [CO_2] + [CH_y])}$$

As the overall balance of the elemental species (e.g., C, H, and O) does not change (unless there is storage or release within the catalyst), the amount of change in oxygen from the inlet concentration may be attributed to a change in the ceria FOS. Further, this equation may be used to validate the model by comparing the calculated species concentrations to the measured air-fuel ratio, both upstream and downstream of the catalyst.

The TOSC represents the total oxygen storage capacity and as each ceria ($Ce_2O_3$) molecule stores half a mole of oxygen, the TOSC may be equivalent to half the total ceria capacity.

At 514, tailpipe emissions may be calculated, using change in the concentration of the species at the outlet of the catalyst. In some embodiments, if the emissions of the regulated species, NOx, CO, and HC, are above a threshold, engine operation may be adjusted to reduce emissions, such as increasing EGR in order to lower NOx. Upon calculating tailpipe emissions, method 500 returns.

Thus, the methods 400 and 500 presented above with respect to FIGS. 4 and 5 provide for a method for an engine including a catalyst. The method comprises determining catalyst activity based on an error between predicted exhaust gas sensor output and measured exhaust gas sensor output; applying the catalyst activity and a plurality of inlet exhaust species concentrations to a catalyst model including a set of axially-averaged mass balances and energy balances of a fluid phase and washcoat of the catalyst to determine a total oxygen storage capacity and fractional oxidation state of the catalyst; maintaining a desired air-fuel ratio based on the total oxygen storage capacity and fractional oxidation state of the catalyst; and indicating catalyst degradation if the catalyst activity or total oxygen storage capacity is less than a threshold. In this way, each exhaust gas species may be input into a catalyst model, which axially averages catalyst dynamics, such as temperature, composition, etc. Based on the catalyst model, air-fuel ratio may be controlled, and catalyst degradation may be indicated.

While the embodiment described with respect to FIGS. 4 and 5 calculates the mass balance for seven separate exhaust gas species (CO, HC, NOx, $H_2$, $H_2O$, $O_2$, and $CO_2$), thus allowing monitoring of each species, in some embodiments only one or a combination of the species may be monitored.

For example, rather than calculate a mass balance for each of the separate species, the species may be grouped into oxidants (e.g., $O_2$, and NOx) and reductants (e.g., HC, CO, and $H_2$). Additionally or alternatively, only the change in concentration of desired regulated emissions, such as CO, HC, and NOx, may be monitored.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine exhaust method, comprising:

adjusting, via a first controller communicating with sensors and actuators, a fuel injection amount based on a fractional oxidation state of a catalyst, the fractional oxidation state based on reaction rates of a plurality of exhaust gas species throughout a catalyst longitudinal axis and a set of axially-averaged mass balance and energy balance equations for a fluid phase and a wash-coat of the catalyst, and further based on separate feedback from a downstream air-fuel ratio sensor.

2. The method of claim 1, further comprising adjusting the fuel injection via the first controller based on feedback from an upstream air-fuel ratio sensor.

3. The method of claim 2, wherein the upstream sensor is upstream of the catalyst, and the downstream sensor is downstream of the catalyst.

4. The method of claim 3, wherein the fractional oxidation state adjusts the fuel injection through a second controller, while the separate feedback concurrently adjusts the fuel injection through a third controller separate from the first and second controllers.

5. The method of claim 4, wherein an exhaust gas oxygen set-point provided to the third controller and a fractional oxidant state set-point provided to the second controller are each stored in memory in a controller and indexed with at least one common parameter acting as an operating condition.

6. The method of claim 5, wherein the operating condition includes engine speed.

7. The method of claim 5, wherein the operating condition includes engine load.

8. The method of claim 1, further comprising determining an estimated total oxygen storage capacity and indicating catalyst degradation if the total oxygen storage capacity is below a capacity threshold or if determined catalyst activity is below a calibrated threshold.

9. The method of claim 8, wherein determining the total oxygen storage capacity and fractional oxidation state further comprises determining outlet species concentrations based on inlet species concentrations, the inlet species concentrations determined based on air mass, temperature, exhaust air-fuel ratio, and engine speed.

10. The method of claim 2, wherein reaction rates of the plurality of exhaust gas species and the fractional oxidation state are further based on a determined catalyst gain.

11. A method for an engine including a catalyst, comprising:

determining, via a controller, catalyst activity based on an error between predicted exhaust gas sensor output and measured exhaust gas sensor output;

applying, via the controller, the catalyst activity and a plurality of inlet exhaust species concentrations to a catalyst model including a set of axially-averaged mass balances and energy balances of a fluid phase and wash-coat of the catalyst to determine a total oxygen storage capacity and fractional oxidation state of the catalyst;

maintaining, via the controller, a desired air-fuel ratio based on the total oxygen storage capacity and fractional oxidation state of the catalyst, as well as based on separate feedback from a downstream air-fuel ratio sensor provided in parallel with the fractional oxidation state; and indicating, via the controller, catalyst degradation if the catalyst activity or the total oxygen storage capacity is less than a threshold; and adjusting, via the controller and an actuator, fuel injection via a first controller based on feedback from an upstream air-fuel ratio sensor.

12. The method of claim 11, wherein the upstream sensor is upstream of the catalyst, and the downstream sensor is downstream of the catalyst.

13. The method of claim 12, wherein the fractional oxidation state adjusts the fuel injection through a second controller, while the separate feedback concurrently adjusts the fuel injection through a third controller separate from the first and second controllers.

14. The method of claim 13, wherein an exhaust gas oxygen set-point provided to the third controller and a fractional oxidant state set-point provided to the second controller are each stored in memory in a controller and indexed with at least one common parameter acting as an operating condition.

15. The method of claim 14, wherein the operating condition includes engine speed.

16. The method of claim 14 wherein the operating condition includes engine load.

17. An engine exhaust method, comprising:

adjusting, via a controller communicating with sensors and fuel injectors, a fuel injection amount based on:

a fractional oxidation state (FOS) of a catalyst relative to an FOS set-point, the FOS based on reaction rates of a plurality of exhaust gas species throughout a catalyst longitudinal axis and a set of axially-averaged mass balance and energy balance equations, and separate feedback from a downstream HEGO sensor relative to a HEGO set-point, the FOS and HEGO set-points tied together.

18. The method of claim 17, wherein the FOS and HEGO set-points are directly tied together.

19. The method of claim 17, wherein the FOS set-point increases with increasing engine speed, and the HEGO set-point decreases with increasing engine speed.

* * * * *